US006220073B1

(12) United States Patent
Cheng et al.

(10) Patent No.: US 6,220,073 B1
(45) Date of Patent: Apr. 24, 2001

(54) CAN BOTTOM HAVING IMPROVED STRENGTH AND APPARATUS FOR MAKING SAME

(75) Inventors: Gin-Fung Cheng, Downers Grove; Floyd A. Jones, Wheaton, both of IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/557,522

(22) Filed: Apr. 25, 2000

Related U.S. Application Data

(60) Division of application No. 09/325,591, filed on Jun. 3, 1999, now Pat. No. 6,131,761, which is a continuation-in-part of application No. 09/090,000, filed on Jun. 3, 1998, now abandoned.

(51) Int. Cl.[7] ..... B21D 51/26
(52) U.S. Cl. ..... 72/348; 72/379.4
(58) Field of Search ..... 72/348, 379.4

(56) References Cited

U.S. PATENT DOCUMENTS

| | | | |
|---|---|---|---|
| 3,355,060 | 11/1967 | Reynolds et al. | 220/54 |
| 3,409,167 | 11/1968 | Blanchard | 220/66 |
| 3,423,985 | 1/1969 | Stolle et al. | 72/248 |
| 3,690,507 | 9/1972 | Gailus et al. | 220/66 |
| 3,693,828 | 9/1972 | Kneusel et al. | 220/608 |
| 3,730,383 | 5/1973 | Dunn et al. | 220/66 |
| 3,760,751 | 9/1973 | Dunn et al. | 113/120 H |
| 3,904,069 | 9/1975 | Toukmanian | 220/66 |
| 3,905,507 | 9/1975 | Lyu | 220/66 |
| 3,942,673 | 3/1976 | Lyu et al. | 220/66 |
| 3,979,009 | 9/1976 | Walker | 220/66 |
| 4,037,752 | 7/1977 | Dulmaine et al. | 220/70 |
| 4,048,934 | 9/1977 | Wallace | 220/608 |
| 4,065,951 | 1/1978 | Lyu | 72/349 |
| 4,147,271 | 4/1979 | Yamaguchi | 220/70 |
| 4,151,927 | 5/1979 | Cvacho et al. | 220/70 |
| 4,177,746 | 12/1979 | Lee, Jr. et al. | 220/66 |
| 4,222,494 | 9/1980 | Lee, Jr. et al. | 220/66 |
| 4,294,373 | 10/1981 | Miller et al. | 220/70 |
| 4,381,061 | 4/1983 | Cerny et al. | 215/1 C |
| 4,412,627 | 11/1983 | Houghton et al. | 220/66 |
| 4,426,013 | 1/1984 | Cherchian et al. | 220/66 |

(List continued on next page.)

FOREIGN PATENT DOCUMENTS 2114031 8/1983 (GB) .

*Primary Examiner*—Lowell A. Larson
(74) *Attorney, Agent, or Firm*—Woodcock Washburn Kurtz Mackiewicz & Norris LLP

(57) ABSTRACT

A can bottom having an approximately frustoconical portion extending downwardly and inwardly from the can side wall, an annular nose portion extending downwardly from the approximately frustoconical portion, and a central portion extending upwardly and inwardly from the nose. The nose is formed by inner and outer circumferentially extending frustoconical walls that are joined by a downwardly convex arcuate portion. The inner surface of the arcuate portion of the nose has a radius of curvature adjacent the nose inner wall of at least 0.060 inch. The central portion of the can bottom has a substantially flat disc-shaped central section, having a diameter of at least about 1.40 inches, and an approximately dome-shaped and downwardly concave having a radius of curvature no greater than 1.475 inches. In a preferred embodiment of the invention, the inner surface of the arcuate portion of the nose is formed by a sector of a circle and has radius of curvature is no greater than about 0.070 inch. An apparatus for making the can bottom comprises a nose punch whose distal end has a radius of curvature that is equal to the radius of curvature of the can bottom nose and a die whose radius of curvature equals that of the dome.

2 Claims, 5 Drawing Sheets

U.S. PATENT DOCUMENTS

| | | | |
|---|---|---|---|
| 4,431,112 | 2/1984 | Yamaguchi | 220/70 |
| 4,472,440 | 9/1984 | Bank | 426/128 |
| 4,515,284 | 5/1985 | Lee, Jr. et al. | 220/70 |
| 4,617,778 | 10/1986 | Blackman | 53/391 |
| 4,646,930 | 3/1987 | Karas et al. | 220/70 |
| 4,685,582 | 8/1987 | Pulciani et al. | 220/66 |
| 4,768,672 | 9/1988 | Pulciani et al. | 220/66 |
| 4,785,607 | 11/1988 | Blackman | 53/391 |
| 4,885,924 | 12/1989 | Claydon et al. | 72/109 |
| 5,069,052 | 12/1991 | Porucznik et al. | 72/84 |
| 5,111,679 * | 5/1992 | Kobayashi et al. | 72/348 |
| 5,325,696 * | 7/1994 | Jentzsch et al. | 72/379.4 |
| 5,347,839 | 9/1994 | Saunders | 72/347 |
| 5,351,852 | 10/1994 | Trageser et al. | 220/606 |
| 5,540,352 | 7/1996 | Halasz et al. | 220/608 X |
| 5,605,069 | 2/1997 | Jentzsch | 72/347 |
| 5,605,248 | 2/1997 | Jentzsch | 220/608 |
| 5,730,314 | 3/1998 | Wiemann et al. | 220/609 |

* cited by examiner

CAN BOTTOM HAVING IMPROVED STRENGTH AND APPARATUS FOR MAKING SAME

RELATED APPLICATION

This application is a divisional of U.S. application Ser. No. 09/325,591 filed Jun. 3, 1999, now U.S. Pat. No. 6,131,761, which is a continuation-in-part of U.S. application Ser. No. 09/090,000 filed Jun. 3, 1998, now abandoned, entitled Can Bottom Having Improved Pressure Resistance and Apparatus for Making Same, both of which are hereby incorporated by reference in their entirety.

FIELD OF THE INVENTION

The current invention is directed to a can, such as a metal can used to package carbonated beverages. More specifically, the current invention is directed to a can bottom having improved strength.

BACKGROUND OF THE INVENTION

In the past, cans for packaging carbonated beverages, such as soft drinks or beer, have been formed from metal, typically aluminum. Such cans are conventionally made by attaching a can end, or lid, to a drawn and ironed can body that has an integrally formed bottom.

Certain parameters relating to the geometry of the can bottom play an important role in the performance of the can. In can bottoms employing an annular nose, discussed further below, the diameter of the nose affects the ability to stack or nest the bottom of one can into the top end of another can. Nose diameter also affects the resistance of the can to tipping over, such as might occur during filling.

In addition to stacking ability and anti-tipping stability, strength is also an important aspect of the performance of the can bottom. For example, since its contents are under pressure, which may be as high as 90 psi the can must be sufficiently strong to resist excessive deformation due to internal pressurization. Therefore, an important strength parameter for the can bottom is buckle strength, which is commonly defined as the minimum value of the internal pressure required to cause reversal, or inversion, of the domed portion of the can bottom—that is, the minimum pressure at which the center portion of the can bottom flips from being concave downward to convex downward. Another important parameter is drop resistance, which is defined as the minimum height required to cause dome inversion when a can filled with water and pressurized to 60 psi is dropped onto a hard surface.

In addition to satisfying performance requirements, there is tremendous economic incentive for can makers to reduce the amount of metal used. Since billions of such cans are sold each year, even slight reductions in metal usage are desirable. The overall size and general shape of the can is specified to the can maker by the beverage industry. Consequently, can makers are constantly striving to reduce the thickness of the metal by refining the details of the can geometry to obtain a stronger structure. Only a few years ago, aluminum cans were formed from metal having a thickness of about 0.0112 inch. However, aluminum cans having thicknesses as low as 0.0108 inch are now available.

One technique for increasing the strength of the can bottom that has enjoyed considerable success is the forming of a outwardly concave dome in the can bottom. Beverage cans, such as those for soft drinks and beer, typically have a side wall diameter of about 2.6 inches. Conventionally, the radius of curvature of the bottom dome is at least 1.550 inch. For example, U.S. Pat. No. 4,685,582 (Pulciani et al.), assigned at issue to National Can Corporation, discloses a can having a side wall diameter of 2.597 inches and a dome radius of curvature of 2.120 inches. Similarly, U.S. Pat. No. 4,885,924 (Claydon et al.), assigned at issue to Metal Box plc, discloses a can having a side wall diameter of 2.59 inches and a dome radius of curvature of 2.0 inches, while U.S. Pat. No. 4, 412,627 (Houghton et al.), assigned at issue to Metal Container Corp, discloses a can having a side wall diameter of 2.600 inches and a dome radius of curvature of 1.750 inches.

The strength of a domed can bottom is further increased by forming a downwardly and inwardly extending frustoconical wall on the periphery of the bottom that terminates in an annular bead, or nose. The nose has circumferentially extending inner and outer walls, which may also be frustoconical. The inner and outer walls are joined by an outwardly convex arcuate portion, which may be formed by a sector of a circle. The base of the arcuate portion forms the surface on which the can rests when in the upright orientation.

According to conventional can making technology, the radius of curvature of the inner surface of the arcuate portion of the nose in such domed, conically walled can bottoms was generally 0.050 inch or less. For example, prior to the development of the current invention, the parent of the assignee of the instant application, Crown Cork & Seal Company, sold aluminum cans with 202 ends (i.e., the diameter of the can end opposite the bottom is 2 7/16 inch) in which the radius of curvature of the inside surface of the nose was 0.050 inch. Similarly, U.S. Pat. Nos. 3,730,383 (Dunn et al.), assigned at issue to Aluminum Company of America, and U.S. Pat. No. 4,685,582 (Pulciani et al.), assigned at issue to National Can Corporation, disclose a nose having a radius of curvature of 0.040 inch.

Moreover, it was heretofore generally thought that the smaller the radius of curvature of the nose, the greater the pressure resistance of the can bottom, as discussed, for example, in the aforementioned U.S. Pat. No. 3,730,383. Consequently, U.S. Pat. No. 4,885,924 (discussed above), U.S. Pat. No. 5,069,052 (Porucznik et al.), assigned at issue to CMB Foodcan plc, and U.S. Pat. No. 5,351,852 (Trageser et al.), assigned at issue to Aluminum Company of America, all disclose methods for reducing the radius of curvature of the nose in order to increase the strength of the can bottom. U.S. Pat. No. 5,351,852 suggests reworking the nose so as to reduce its radius of curvature to 0.015 inch, while U.S. Pat. No. 3,069,052 suggests reworking the nose so as to reduce its radius of curvature on the inside surface to zero and on the outside surface to 0.040 inch or less.

In addition to its geometry, the manufacturing apparatus and techniques employed in forming the can bottom can affect its strength. For example, small surface cracks can be created in the chime area of the can bottom if the metal is stretched excessively when the nose is formed. If, as sometimes occurs, these cracks do not initially extend all the way through the metal wall, they may go undetected during inspection by the can maker. This can result in failure of the can after it has been filled and closed, which is very undesirable from the standpoint of the beverage seller or the ultimate customer. The smaller the radius of curvature of the nose, the more likely that such cracking will occur. Since the radius of curvature of the nose adjacent its inner wall is thought to have a greater impact on buckle strength than the radius adjacent the outer wall, some can manufacturers have utilized a nose shape that is more complex than a simple circle sector by employing two radii of curvature—a first inside surface radius of curvature adjacent the outer wall that is above 0.060 inch and a second inside surface radius of curvature adjacent the inner wall that is below 0.060 inch. For example, U.S. Pat. No. 4,431,112 (Yamaguchi), assigned at issue to Daiwa Can Company, discloses a domed can bottom, although one that does not have a conical peripheral wall, with a nose having a first radius of curvature adjacent its inner wall of about 0.035 inch (0.9 mm) and a second radius of curvature adjacent its outer wall of about 0.091 inch (2.3 mm). Another can manufacturer has employed a domed, conically walled bottom in a 204 end can in which the inner surface of the nose, whose outer wall is inclined at an angle of about 26.5° with respect to the can axis, has a fit radius of curvature adjacent the nose inner wall of about 0.054 inch and a second radius of curvature adjacent the outer wall of about 0.064 inch.

Notwithstanding the improvements heretofore achieved in the art, it would be desirable to provide a can bottom having a geometry that optimized performance, especially with respect to buckle resistance, drop resistence, and stackability and manufacturability.

SUMMARY OF THE INVENTION

It is an object of the current invention to provide a can bottom having a geometry that optimized performance, especially with respect to buckle resistance, stackability and manufacturability. This and other objects is accomplished in a can comprising a side wall portion and a bottom portion formed integrally with the side wall portion. The bottom portion comprises (i) an approximately frustoconical portion that extends downwardly and inwardly from the side wall portion, (ii) an annular nose portion that extends downwardly from the approximately frustoconical portion, (iii) a substantially flat disc-shaped central section, and (iv) an annular dome section disposed between the substantially flat central section and the nose, the annular dome section being arcuate in transverse cross-section and downwardly concave, the annular dome section having a radius of curvature no greater than about 1.475 inches.

In one embodiment of the invention, the can side wall has a diameter of about 2.6 inches, the radius of curvature of the annular dome section is about 1.45 inches, the substantially flat disc-shaped central section has a diameter of at least about 0.14 inches, and the substantially flat disc-shaped central section is displaced from a base portion of the nose by a height that is at least about 0.41 inches. In this embodiment, the nose portion is formed by inner and outer circumferentially extending walls joined by a downwardly convex arcuate portion that has inner and outer surfaces, and the inner surface of the arcuate portion has a radius of curvature adjacent the nose inner wall of at least 0.060 inch.

The invention also encompasses an apparatus for forming can bottom that has an annular nose formed therein. The apparatus comprises (i) a centrally disposed die having a forming surface that is approximately dome-shaped and upwardly convex, the forming surface having a radius of curvature no greater than about 1.475 inches, (ii) a nose punch movable relative to the die, the nose punch having a distal end, the distal end formed by inner and outer circumferentally extending walls joined by a downwardly convex arcuate portion, the arcuate portion having a radius of curvature adjacent the inner wall that is within the range of 0.060 to 0.070 inches, and (iii) a ram for causing relative motion between the nose punch and the die.

DESCRIPTION OF THE PREFERRED EMBODIMENT

Figure 1:
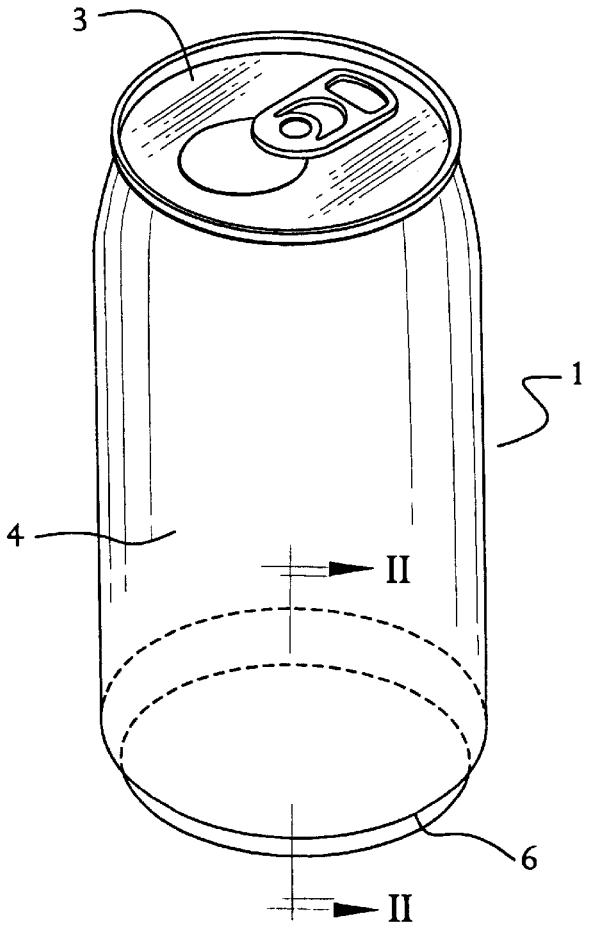
FIG. 1 is an isometric view of a can having a bottom according to the current invention.

A can 1 according to the current invention is shown in FIG. 1. As is conventional, the can comprises an end 3, in which an opening is formed, and a can body. The can body is formed by a cylindrical side wall 4 and a bottom 6 that is integrally formed with the side wall. The side wall 4 has a diameter $D_1$. As is also convention, the can body is made from a metal, such as steel or, more preferably, aluminum, such as type 3204, 3302 or 3004 aluminum plate having an H-19 temper.

Figure 2:
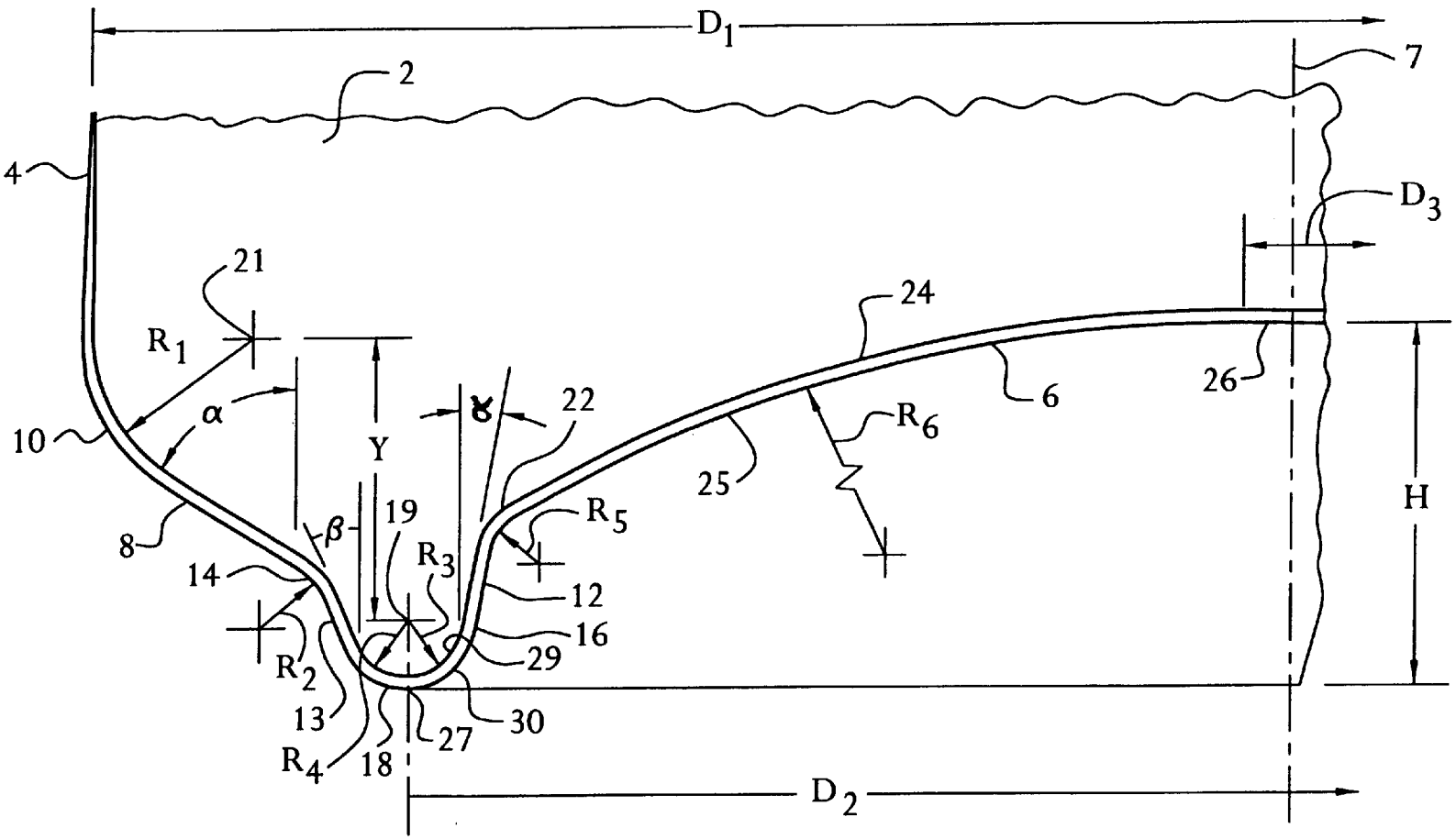
FIG. 2 is a cross-section taken through line II—II shown in FIG. 1, showing the can bottom according to the current invention.

As shown in FIG. 2, the can bottom 6 comprises an approximately frustoconical portion 8 that extends downwardly and inwardly from the side wall 4. The frustoconical portion 8 includes an arcuate section 10, having a radius of curvature R., that forms a smooth transition into the side wall 4. The frustoconical portion 8 also preferably includes a straight section that forms an angle $\alpha$ with respect to the axis 7 of the side wall 4.

As also shown in FIG. 2, an annular nose 16 extends downwardly from the frustoconical portion 8. The nose 16 preferably comprises inner and outer approximately frustoconical walls 12 and 13, respectively. It should be noted that the inner wall 12 is sometimes referred to in the art as the "chime." Preferably, the inner wall 12 has a straight section that forms an angle $\gamma$ with respect to the axis 7 of the side wall 4, while the outer wall 13 has a straight section that forms an angle $\beta$ with respect to the axis. The inner and outer walls 12 and 13 are joined by a circumferentially extending arcuate section 18. The inner wall 12 includes an arcuate section 22, having a radius of curvature $R_5$, that forms a smooth transition into a center portion 24 of the bottom 6. The outer wall 13 includes an arcuate section 14, having a radius of curvature R2, that forms a smooth transition into the frustoconical portion 8.

In transverse cross-section, the portion of the inner surface 29 of the arcuate section 18 of the nose 16 adjacent the inner wall 12 has a radius of curvature $R_3$. Similarly, the portion of the inner surface 29 of the arcuate section 18 adjacent the outer wall 13 has a radius of curvature $R_4$. The radii of curvature of the outer surface 30 of the nose 16 will be equal to the radii of curvature of the inner surface 29 plus the thickness of the metal in the arcuate portion 18 of the nose, which is generally essentially the same as the starting metal plate. Preferably, $R_3$ equals $R_4$. Most preferably, the inner surface 29 of the arcuate portion 18 is entirely formed by a sector of a circle so that only one radius of curvature forms the entirety of the arcuate portion 18 of inner surface of the nose 16, as shown in FIG. 2. The center 19 of the radius of curvature $R_3$ forms a circle of diameter $D_2$ as it extends around the circumference of the bottom 6. The base 27 of the nose 16, on which the can 1 rests when in the upright orientation, is also formed around diameter $D_2$. The center 21 of radius of curvature $R_1$ of the arcuate section 10 is displaced from the center 19 of radius of curvature $R_3$ in the axial direction by a distance Y. Preferably, as the value of $R_3$ is increased, as discussed below, the value of Y is decreased so that the sum of $Y+R_3$ remains constant.

An approximately dome-shaped center portion 24 extends upwardly and inwardly from the nose 16. The most central section 26 of the center portion 24 is disc-shaped, having a diameter $D_3$ and being substantially flat. An annular portion 25 of the center portion 24 is arcuate in transverse cross-section, having a radius of curvature $R_6$, and connects the central section 26 to the inner wall 12 of the nose 16. The can bottom 6 has a dome height H that extends from the base 27 of the nose 16 to the top of the center portion 24.

Figure 3:
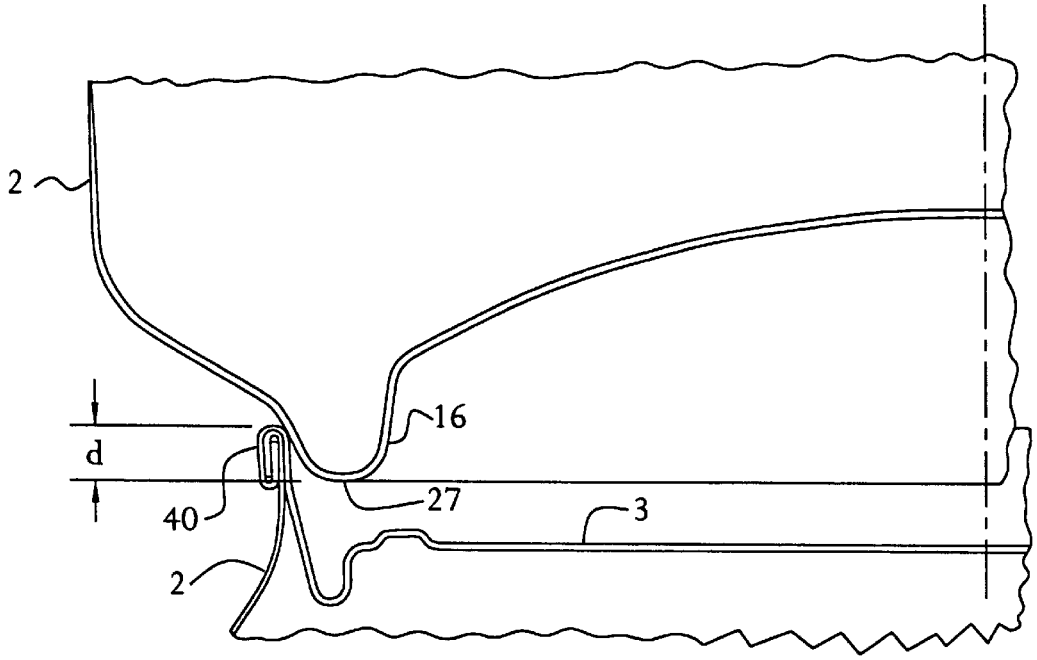
FIG. 3 is a cross-section through the can bottom of the current invention nested into the end of a similar can.

As shown in FIG. 3, when two similarly constructed cans are stacked one atop the other, the bottom 6 of the upper can will penetrate into the end 3 of the lower can so that the base 27 of the nose 16 of the upper can extends a distance d below the lip formed on the seaming panel 40 of the lower can.

Figure 4:
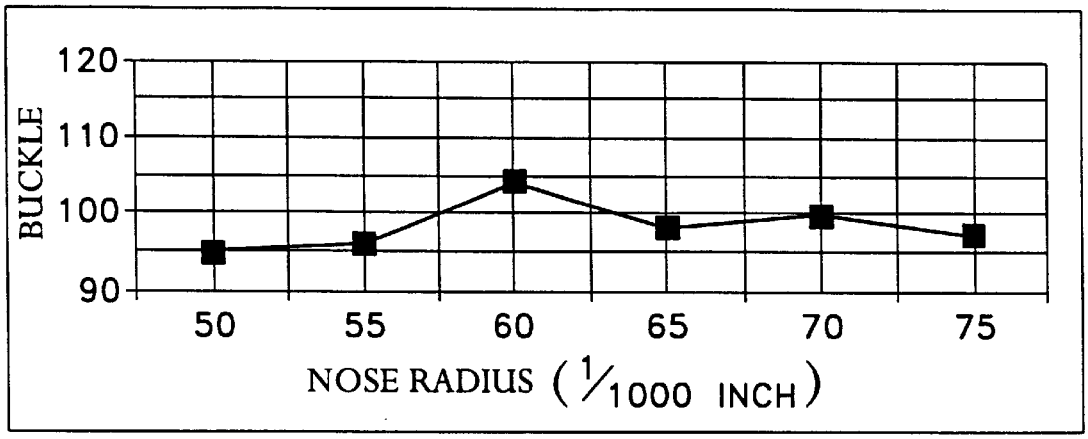
FIG. 4 is a graph showing the effect of varying the radius of curvature of the inner surface of the nose on the buckle strength of a can bottom.

FIG. 4 shows the results of a finite element analysis, or FEA, aimed at showing how the buckle strength, defined as discussed above, varies with the radius of curvature of the nose 16 in the bottom of a can having a 202 end and employing the geometry defined in Table I and shown in FIG. 2:

TABLE I

| Can Bottom Geometric Parameters For FEA | |
|---|---|
| Diameter $D_1$ | 2.608 inches (66.24 mm) |
| Diameter $D_2$ | 1.904 inches (48.36 mm) |
| Diameter $D_3$ | 0.100 inch (2.54 mm) |
| Radius $R_1$ | 0.170 inch (4.32 mm) |
| Radius $R_2$ | 0.080 inch (2.03 mm) |
| Radius $R_3$ | Variable |
| Radius $R_4$ | Equals $R_3$ |
| Radius $R_5$ | 0.060 inch (1.52 mm) |
| Radius $R_6$ | 1.550 inch (39.37 mm) |
| Distance $Y + R_3$ | 0.361 inch (9.17 mm) |
| Dome Height H | 0.405 inch (10.29 mm) |
| Angle $\alpha$ | 60° |
| Angle $\beta$ | 25° |
| Angle $\gamma$ | 8° |

A 202 end can having a bottom defined by the geometry specified in Table I and with a nose 16 having an inner surface 29 with a radius of curvature $R_3$ of 0.050 inch is known in the prior art. As shown in FIG. 4, increasing the radius of curvature $R_3$ of the nose inner surface 29 to 0.060 inch results in a dramatic increase in buckle strength. Specifically, the finite element analysis predicted that, contrary to the conventional wisdom in the can making art, increasing the nose inner surface radius from 0.050 inch to 0.060 inch in such a can bottom would increase the buckle strength by almost 10%, from 95 psi to 104 psi.

Unfortunately, increases in the nose inner surface radius of curvature beyond 0.060 inch did not yield continued increases in buckle strength, but actually reduced buckle strength, although the buckle strength remained above that obtained with the 0.050 inch radius of curvature previously employed for such a can bottom.

In order to check these theoretical predictions, twelve ounce beverage cans having 202 ends were made using bottom geometries specified in Table I and shown in FIG. 2 with three different radii of curvature $R_3$ for the inner surface 29 of the nose arcuate portion 18—0.050, 0.055 and 0.060 inch. Cans with each size radius of curvature were made using two different dome heights H and from two different types of 0.0108 inch (0.27 mm) thick aluminum plate—type 3204 H-19 and type 3304C5 H-19 so that, altogether, there were twelve different types of cans. The cans were tested for four strength related parameters—(i) buckle strength, defined as discussed above, (ii) bottom strength, obtained by measuring the minimum axial load required to collapse the can bottom when the side wall is supported, (iii) drop resistance, obtained by dropping water-filled cans pressurized to 60 psi from varying heights, and (iv) axial load, obtained by measuring the minimum axial load required to collapse the unsupported can side wall. The results of these tests, which are averaged for at least six cans of each type, are shown in Table II. In addition, the penetration depth d at stacking was measured and is shown in Table III.

TABLE II

| Comparative Test Results-Variable Nose Radius Of Curvature | Buckle Strength (psi) | Bottom Strength (lbs) | Drop Resistance (inches) | Axial Load (lbs) |
|---|---|---|---|---|
| Type 3204 H-19 Aluminum | | | | |
| H = 0.0405 | | | | |
| $R_3$ = 0.050 | 96.7 | 273.7 | 6.7 | 232.8 |
| $R_3$ = 0.055 | 98.3 | 274.7 | 6.9 | 229.6 |
| $R_3$ = 0.060 | 103.8 | 284.7 | 7.6 | 205.1 |
| H = 0.0415 | | | | |
| $R_3$ = 0.050 | 97.7 | 273.0 | 6.7 | 227.6 |
| $R_3$ = 0.055 | 99.5 | 276.7 | 6.8 | 231.2 |
| $R_3$ = 0.060 | 105.0 | 283.7 | 6.8 | 220.9 |
| Type 3304C5 H-19 Aluminum | | | | |
| H = 0.0405 | | | | |
| $R_3$ = 0.050 | 95.7 | 268.7 | 5.9 | 245.3 |
| $R_3$ = 0.055 | 99.5 | 278.0 | 5.9 | 237.8 |
| $R_3$ = 0.060 | 100.5 | 268.3 | 6.8 | 245.7 |
| H = 0.0415 | | | | |
| $R_3$ = 0.050 | 96.7 | 269.3 | 6.0 | 238.8 |
| $R_3$ = 0.055 | 99.5 | 275.7 | 6.1 | 242.7 |
| $R_3$ = 0.060 | 100.8 | 272.0 | 6.3 | 237.0 |

TABLE III

| Comparative Test Results-Nose Radius vs. Stacking Depth | |
|---|---|
| Radius of Curvature. $R_3$ | Stacking Depth. d |
| 0.050 inch | 0.083 inch |
| 0.055 inch | 0.069 inch |
| 0.060 inch | 0.062 inch |

The comparative strength test results shown in Table II confirm the fact that, contrary to Me conventional wisdom, increasing the radius of curvature $R_3$ of the inner surface 29 of the arcuate portion 18 of the nose 16 on can bottoms of the type specified in Table I and shown in FIG. 2, at least up to 0.060 inch, increases, rather than decreases, the buckle resistance.

Unfortunately, as shown in Table III, it was found that although increasing the radius of curvature $R_3$ of the nose 16 at its inner surface 29 from 0.050 inch to 0.060 inch dramatically increased buckle strength, it reduced the depth of penetration at stacking from 0.083 inch to 0.062 inch. This undesirable aspect, which compromises the stackability of the can, occurred because increasing the radius $R_3$ of the nose inner surface 29 pushes the nose outer wall 13 radially outward.

Figure 5:
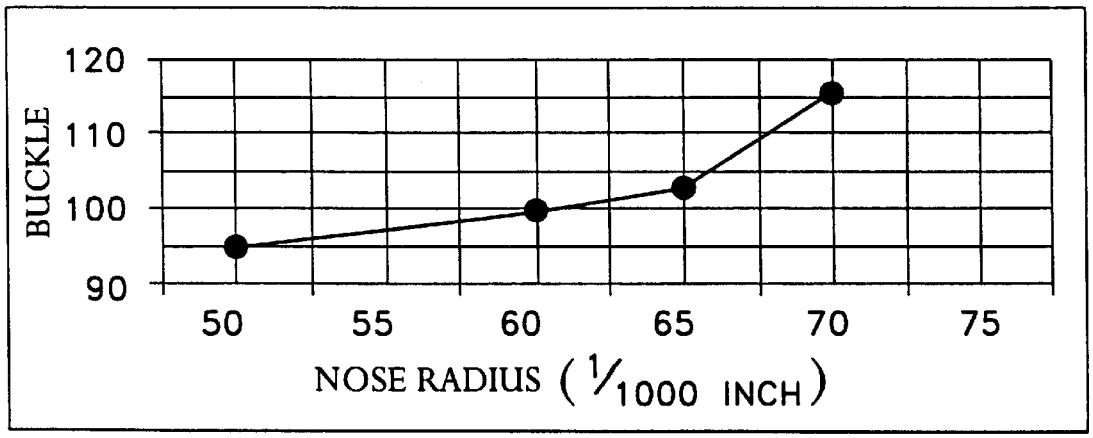
FIG. 5 is a graph showing the effect of varying the radius of curvature of the inner surface of the nose on the buckle strength of a can bottom when the diameter of the nose is varied so as to maintain approximately constant depth of penetration at nesting.

FIG. 5 shows the results of a finite element analysis of a can bottom having the geometry specified in Table I and shown in FIG. 2 except that the diameter $D_2$ of the nose 16 was decreased as its radius of curvature $R_3$ at the nose inner surface increased in the manner shown in Table IV:

TABLE IV

Variation of Nose Diameter With Nose Radius of Curvature

| Nose Radius. $R_3$ (inches) | Nose Diameter. $D_2$ (inches) |
|---|---|
| 0.050 | 1.904 |
| 0.060 | 1.890 |
| 0.065 | 1.884 |
| 0.070 | 1.877 |

As can be seen in FIG. 5, coupling increases in the nose radius of curvature $R_3$ with appropriate decreases in the nose diameter $D_2$ theoretically results in constantly increasing buckle strength within the 0.050 inch to 0.070 inch nose radius range. In fact, the most dramatic increase occurs as the radius of curvature of the inside surface of the nose is increased from 0.065 inch to 0.070 inch.

In order to test the theoretical predictions from the finite element analysis discussed above, twelve ounce cans having 202 ends, and bottoms as shown in FIG. 2, were made from Alcoa 3004 H-19 aluminum plate having an initial thickness of 0.0108 inch (0.27 mm). Half of the cans were made using a bottom geometry that is known in the prior art, which is designated A in Table V, and the other half were made using one embodiment of the geometry of the current invention, which is designated B. Consistent with the theoretical analysis discussed above, the two can bottom geometries differed in two respects. First, contrary to conventional thinking, the radius of curvature $R_3$ of the nose 16 at its inner surface 29 was increased to 0.060 inch. Second, the diameter $D_2$ of the nose was decreased to 1.890 inch.

TABLE V

Can Bottom Geometric Parameters For Comparative Testing-Nose Dim.

| | Can Bottom A | Can Bottom B |
|---|---|---|
| Diameter $D_1$ | 2.608 inches (66.24 mm) | 2.608 inches (66.24 mm) |
| Diameter $D_2$ | 1.904 inches (48.36 mm) | 1.890 inches (45.95 mm |
| Diameter $D_3$ | 0.100 inch (2.54 mm) | 0.100 inches (2.54 mm) |
| Radius $R_1$ | 0.170 inch (4.32 mm) | 0.170 inch (4.32 mm) |
| Radius $R_2$ | 0.080 inch (2.03 mm) | 0.080 inch (2.03 mm) |
| Radius $R_3$ | 0.050 inch (1.27 mm) | 0.060 inch (1.52 mm) |
| Radius $R_4$ | 0.050 inch (1.27 mm) | 0.060 inch (1.52 mm) |
| Radius $R_5$ | 0.060 inch (1.52 mm) | 0.060 inch (1.52 mm) |
| Radius $R_6$ | 1.550 inch (39.37 mm) | 1.550 inch (39.37 mm) |
| Distance Y + $R_3$ | 0.361 inch (9.17 mm) | 0.361 inch (9.17 mm) |
| Height H | 0.405 inch (10.29 mm) | 0.405 inch (10.29 mm) |
| Angle $\alpha$ | 60° | 60° |
| Angle $\beta$ | 24° | 25° |
| Angle $\gamma$ | 8° | 8° |

Comparative testing was again preformed on the two groups of cans and the results, which are reported as the average for at least six cans, are shown in Table VI.

TABLE VI

Comparative Test Results-Varying Nose Radius And Nose Diameter

| | Can Bottom A | Can Bottom B |
|---|---|---|
| Buckle Strength | 93.7 psi | 100.1 psi |
| Bottom Strength | 267.2 lbs | 269.7 lbs |
| Drop Resistance | 7.3 inches | 6.8 inches |
| Axial Load | 224.1 lbs | 236.8 lbs |
| Penetration Depth d | 0.085 inch (2.16 mm) | 0.086 inch (2.18 mm) |

As can be seen, the buckle strength of the cans made according to the current invention was almost 7% greater than that of the prior art cans (i.e., 100.1 psi versus 93.7 psi). Such an increase is very significant. For example, it is expected that this increase in buckle strength will allow the 90 psi buckle strength requirement commonly imposed by carbonated beverage bottlers to be satisfied even if the thickness of the initial metal plate is reduced from 0.0108 inch to 0.0104 inch—a reduction of almost 4%. Such a reduction in plate thickness will yield a significant cost savings. The slight reduction in drop resistance is not thought to be statistically significant.

The thickness of the metal in the inner chime wall 12 was also measured for the two types of cans. These measurements showed that the chime wall thickness for the can bottom according to the current invention (type B) was 0.0003 inch greater than that for the can bottom of the prior art (type A)—i.e.,. 0.0098 inch (0.249 mm) versus 0.0095 (0.241 mm). The increase in chime wall thickness is also significant because it shows that the current invention results in less stretching of the metal in the critical chime area (the more the metal is stretched, the thinner it becomes). Manufacturing trials have shown that this reduction in metal stretching reduces the incidence of can failure due to chime surface cracking.

Finally, by decreasing the nose diameter $D_2$, the depth of penetration d was maintained, thereby ensuring that the increase in nose radius of curvature did not compromise stackability even in a can having a relatively small end (i.e., size 202). In this regard, the relatively small angle $\beta$ of the nose outer wall 13 (i.e., 25°) also aids in obtaining good penetration. Thus, according to the current invention, if good stackability is a requirement, (i) the radius of curvature $R_3$ of the inner surface 29 of the arcuate portion 18 of the nose 16 should be maintained within the 0.060 inch to 0.070 inch range, (ii) the angle $\beta$ of the outer wall 13 of the nose should be no greater than about 25°, and (iii) the diameter $D_2$ of the nose should be no greater than 1.89 inch for cans having ends of size 202 or smaller.

Unfortunately, decreasing the nose diameter $D_2$ will reduce the tipping stability of the can when oriented in the upright position. Tipping stability is important since a wobbly can may not fill properly during processing and may cause an annoyance to the ultimate consumer. Therefore, it may be undesirable to increase the nose radius of curvature to values beyond 0.070 inch in cans having 202 ends, since that would result in nose diameters less than 1.877 inch if the stacking penetration is maintained constant. Moreover, although the greatest increase in buckle strength was obtained with a 0.070 inch value for the nose inner surface radius $R_3$, this value also results in the smallest nose diameter $D_2$. Therefore, depending on the relative importance of the stackability versus the tipping stability requirements, the optimum value of the radius of curvature $R_3$ of the inner surface 29 of the arcuate portion 18 of the nose 16 may be less than 0.070 inch, such as about 0.060 inch or about 0.065 inch.

According to another aspect of the invention, the strength of the bottom 6 can also be increased by careful adjustment of the radius $R_6$ of the center portion 24. Specifically, it has been found that a surprising increase in the drop resistence can be achieved by reducing the radius $R_6$. This reduction in $R_6$ is preferably accompanied by an increase in the diameter $D_3$ of the substantially flat central section 26 and an increase in the dome height H.

Table VII shows the results of drop resistance and buckle strength testing for 12 ounce 202 cans having three different bottom geometries. The bottom geometries were the same as those of Can Bottom B shown in Table V unless otherwise indicated. Each can bottom was formed from aluminum (Alcoa 3104) of three different initial thicknesses on a pilot line. Twelve cans were tested in each geometry/thickness. The results of tests on these cans are shown in Tables VI and VII below.

TABLE VI

Comparative Test Results-Varying Dome Dimensions-Pilot Line

| | Can Bottom B | Can Bottom C | Can Bottom D |
|---|---|---|---|
| Radius $R_6$ | 1.550 in (39.37 mm) | 1.475 in (37.47 mm) | 1.450 in (36.83 mm) |
| Diameter $D_3$ | 0.100 in (2.54 mm) | 0.140 in (3.56 mm) | 0.139 in (3.53 mm) |
| Height H | 0.405 in (10.29 mm) | 0.405 in (10.29 mm) | 0.410 in (10.41 mm) |
| Remaining parameters the same as Table I | | | |
| | 0.0108 inch Thickness | | |
| Drop Resistance | | | |
| Average | 6.07 inches | 6.64 inches | 8.00 inches |
| Maximum | 7 inches | 8 inches | 9 inches |
| Minimum | 5 inches | 6 inches | 7 inches |
| Buckle Strength | | | |
| Average | 99.8 psi | 98.2 psi | 98.7 psi |
| Maximum | 100.4 psi | 99.0 psi | 99.5 psi |
| Minimum | 99.2 psi | 97.6 psi | 97.5 psi |
| | 0.0106 inch Thickness | | |
| Drop Resistance | | | |
| Average | 5.50 inches | 6.07 inches | 7.29 inches |
| Maximum | 6 inches | 7 inches | 8 inches |
| Minimum | 5 inches | 5 inches | 6 inches |
| Buckle Strength | | | |
| Average | 95.2 psi | 94.0 psi | 94.6 psi |
| Maximum | 95.7 psi | 95.6 psi | 95.8 psi |
| Minimum | 94.2 psi | 93.2 psi | 93.7 psi |
| | 0.0104 inch Thickness | | |
| Drop Resistance | | | |
| Average | 4.79 inches | 5.79 inches | 6.36 inches |
| Maximum | 5 inches | 7 inches | 7 inches |
| Minimum | 4 inches | 4 inches | 6 inches |
| Buckle Strength | | | |
| Average | 94.1 psi | 92.3 psi | 93.3 psi |
| Maximum | 95.9 psi | 93.4 psi | 93.8 psi |
| Minimum | 93.7 psi | 91.6 psi | 92.3 psi |

TABLE VII

% Change In Drop Resistance and Buckle Strength Over Bottom B

| | Bottom C | | Bottom D | |
|---|---|---|---|---|
| Metal Thickness | Drop | Buckle | Drop | Buckle |
| 0.0108 inch | +8.6% | −1.6% | +31.8% | −1.1% |
| 0.0106 inch | +10.4% | −1.2% | +32.5% | −0.6% |
| 0.0104 inch | +20.9% | −1.9% | +32.8% | −0.8% |

As can be readily seen, by reducing the dome radius $R_6$ to values no greater than 1.475 inches results in increased drop resistance. Specifically, reducing the dome radius $R_6$ by 0.075 inches from 1.550 inches to 1.475 inches, while simultaneously increasing the diameter $D_3$ of the substantially flat central dome section 26 by 0.040 inches from 0.10 inches to about 0.14 inches (bottom C), results in an increase in drop resistance of about 10 to 20% depending on the metal thickness and a reduction in buckle strength of only about 1 to 2%. Further reducing the dome radius $R_6$ another 0.025 inches to about 1.45 inches, while maintaining $D_3$ at about 0.14 inches and simultaneously increasing the dome height H by 0.005 inches to about 0.41 inches (bottom D) increases the improvement in drop resistance to over 30% for all three metal thickness without further decreases in buckle strength.

In order to confirm these results, 12 ounce 202 cans were made having bottom geometries B and D, as above, as well as geometries E and F, defined generally in Table VII below, at two different commercial can manufacturing plants from 3004 aluminum having an initial thickness of 0.0106 inches.

TABLE VIII

Bottom Geometries-Varying Dome Dimensions-Manufacturing Plants

| | Can Bottom E | Can Bottom F |
|---|---|---|
| Radius $R_6$ | 1.55 in (39.37 mm) | 1.50 in (38.1 mm) |
| Diameter $D_3$ | 0.100 in (2.54 mm) | 0.110 in (2.79 mm) |
| Height H | 0.41 in (10.41 mm) | 0.41 in (10.41 mm) |
| Remaining parameters the same as Table I | | |

Twelve can were made in each of the four geometries. The results of testing on these cans is shown in Table IX below.

TABLE IX

Comparative Tests Results-Varying Dome Dimensions

| | Bottom B | Bottom E | Bottom F | Bottom D |
|---|---|---|---|---|
| | | Plant #1 | | |
| Avg. Height H | 0.406 in | 0.411 in | 0.410 in | 0.411 in |
| Drop Resistance | | | | |
| Average | 5.5 inches | 5.3 inches | 6.0 inches | 6.9 inches |
| Maximum | 6 inches | 6 inches | 7 inches | 8 inches |
| Minimum | 5 inches | 5 inches | 5 inches | 6 inches |

TABLE IX-continued

| Comparative Tests Results-Varying Dome Dimensions | | | | |
|---|---|---|---|---|
| | Bottom B | Bottom E | Bottom F | Bottom D |
| Buckle Strength | | | | |
| Average | 96.9 psi | 97.5 psi | 96.2 psi | 96.4 psi |
| Maximum | 97.6 psi | 98.2 psi | 96.0 psi | 97.0 psi |
| Minimum | 96.0 psi | 96.2 psi | 94.5 psi | 96.0 psi |
| Axial Load | | | | |
| Average | 215.7 lbs | 235.4 lbs | 239.8 lbs | 209.1 lbs |
| Maximum | 249 lbs | 250 lbs | 257 lbs | 246 lbs |
| Minimum | 192 lbs | 192 lbs | 220 lbs | 184 lbs |
| | | Plant #2 | | |
| Avg. Height H | 0.405 in | 0.411 in | 0.411 in | 0.411 in |
| Drop Resistance | | | | |
| Average | 6.3 inches | 5.75 inches | 6.4 inches | 6.6 inches |
| Maximum | 7 inches | 6 inches | 7 inches | 8 inches |
| Minimum | 5 inches | 5 inches | 6 inches | 6 inches |
| Buckle Strength | | | | |
| Average | 96.7 psi | 96.7 psi | 96.7 psi | 96.2 psi |
| Maximum | 97.6 psi | 97.6 psi | 97.8 psi | 96.9 psi |
| Minimum | 96.0 psi | 95.8 psi | 95.9 psi | 94.9 psi |
| Axial Load | | | | |
| Average | 224.5 lbs | 235.4 lbs | 232.5 lbs | 223.6 lbs |
| Maximum | 238 lbs | 245 lbs | 246 lbs | 232 lbs |
| Minimum | 218 lbs | 227 lbs | 180 lbs | 209 lbs |

Since plant #1 had been running 0.0108 inch thick metal just prior to the test, it was suspected that the reduction in axial load for bottom geometry D may have been due to insufficient time to stabilize the process. Consequently, a second batch of geometry D cans were run and found to have about the same drop resistance (6.8 inches average) and buckle strength (95 psi average) but significantly higher axial load (244 lbs average).

As can be seen by comparing the test results for bottom geometry D with those for bottom geometry B, reducing the dome radius $R_6$ to 1.450 inches, along with simultaneously increasing the substantially flat central section diameter $D_3$ to 0.140 inches and increasing the dome height H to 0.410 inches, resulted in a 25.5% increase in drop resistance at plant #1, although only a 4.8% increase at plant #2, with minimal effect on buckle strength (less than 1%). Also, comparing the results for bottom geometry E to bottom geometry B shows that increasing the dome height H without reducing the dome radius $R_6$ actually decreases drop resistance.

Therefore, according to the current invention, in order to optimize the strength of the bottom of a can, such as a can having a sidewall diameter of about 2.6 inches (66 mm). the radius $R_6$ of the dome should be no greater than about 1.475 inches (37.47 mm) and, more preferably, should be about 1.45 inches (36.8 mm). In addition, the diameter $D_3$ of the substantially flat central section should be at least about 0.14 inches (3.6 mm), and preferably should equal about 0.14 inches, and the dome height H should be at least about 0.41 inches (10.4 mm), and preferably should be equal to about 0.41 inches.

A preferred apparatus and method for forming the can bottom 6 disclosed above is discussed below.

In conventional can forming processes, metal stock is placed into a press in which it is deformed into the shape of a cup. The cup is then conveyed to a wall ironing machine and redrawn into the general shape of the side wall and bottom of the finished can. Next, the redrawn cup is passed through ironing stations that eventually form the side wall into the final shape of the finished can. In addition, a bottom forming station is employed to shape the bottom of the can. A can bottom forming station is disclosed in aforementioned U.S. Pat. No. 4,685,582 (Pulciani et al.), hereby incorporated by reference.

Figure 6:
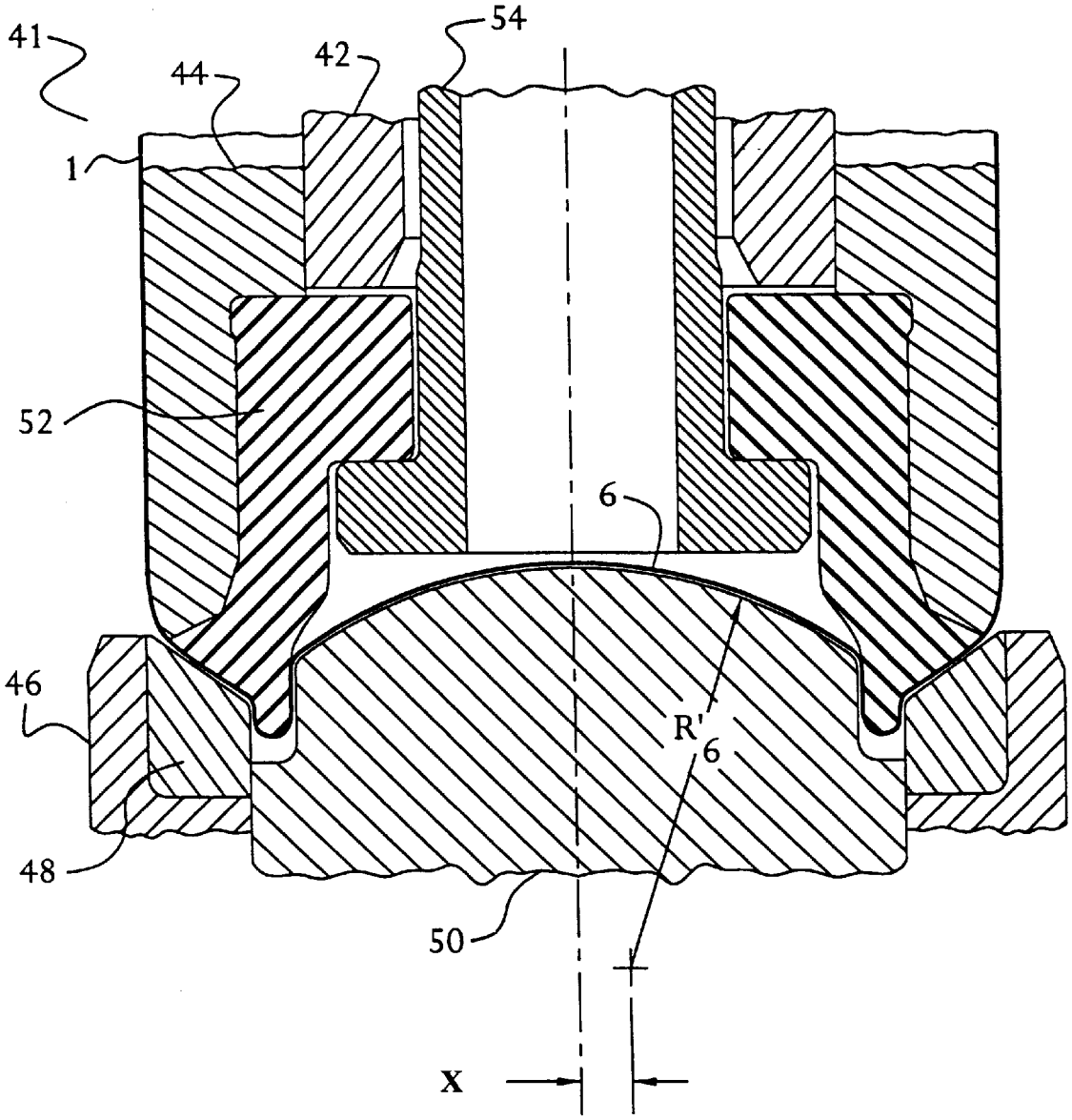
FIG. 6 is a longitudinal cross-section taken through a bottom forming station according to the current invention.

As shown in FIG. 6, an apparatus 41 for making the can bottom 6 of the current invention comprises (i) a ram 42, (ii) a nose punch 52, discussed further below, (iii) a substantially cylindrical punch sleeve 44 encircling the nose punch, (iv) a centrally disposed doming die 50 having an upwardly convex forming surface, (v) a support surface 48, (vi) an extractor 46, and (vii) a central retaining bolt 54.

In operation, the unformed bottom metal stock is placed over the punch sleeve 44 and nose punch 52. The travel of the ram 42 then moves the punch sleeve 44 and nose punch 52 toward the doming die 50 so that the metal stock is eventually pressed against the doming die forming surface and drawn over the distal surfaces of the punch sleeve and the nose punch, as shown in FIG. 6, thereby forming the can bottom 6.

As shown in FIG. 6, the doming die 50 has a radius of curvature $R_6'$ that approximates the radius $R_6$ of curvature of the dome section 24. The radius of curvature $R_6'$ is displaced from the axial centerline by a distance X that approximates one half the diameter $D_3$ of the substantially flat central section 26. Thus, in a preferred embodiment of the invention, the radius of curvature $R_6'$ of the doming die 50 should be no greater than about 1.475 inches (37.47 mm), and more preferably about 1.45 inches (36.8 mm). In addition, the center of $R_6'$ should be displaced from the axial centerline by at least about 0.07 inches (1.8 mm) and the dome height H should be at least about 0.41 inches (10.4 mm).

Figure 7:
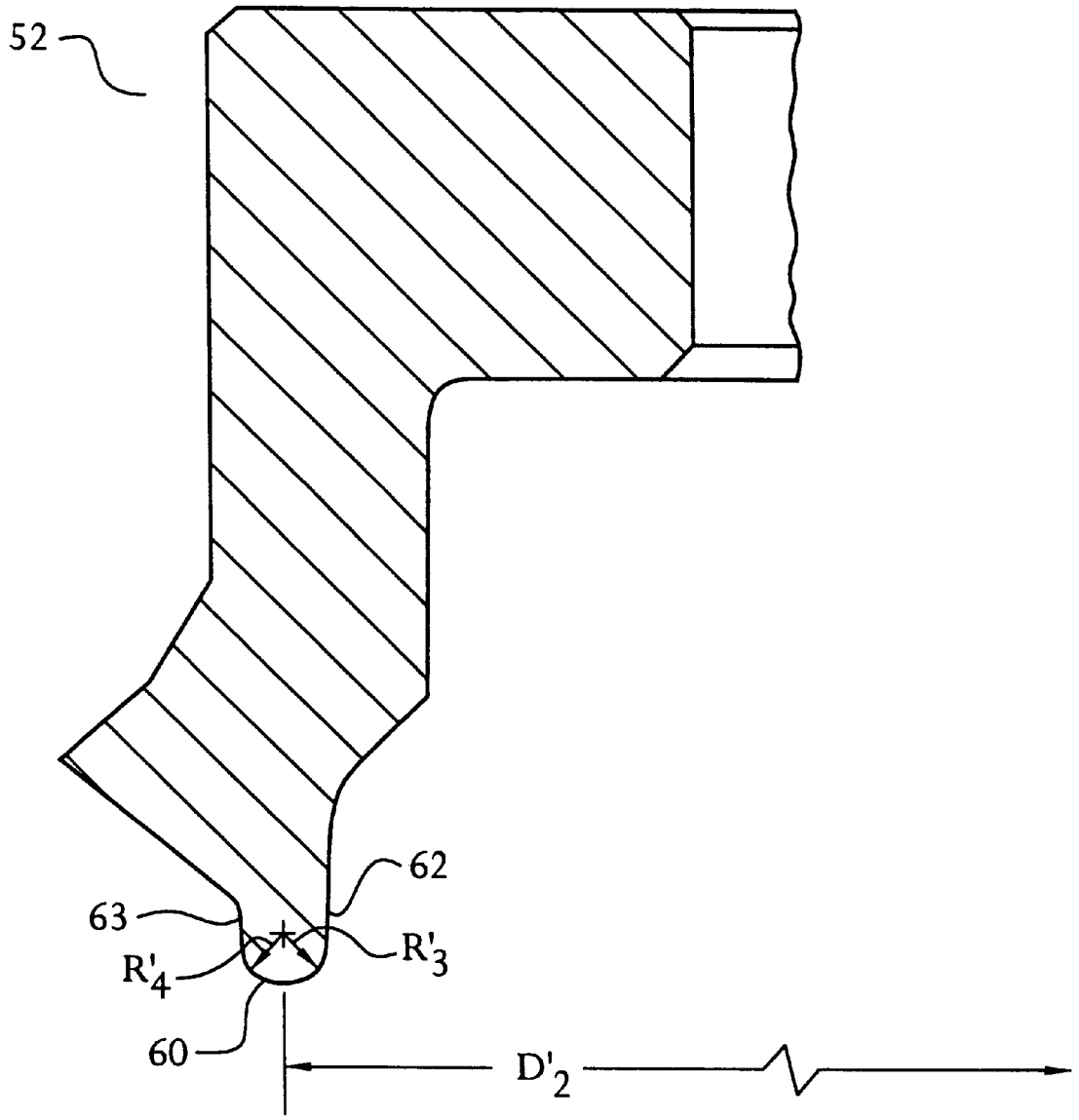
FIG. 7 is a longitudinal cross-section taken through the nose punch according to the current invention shown in FIG. 6.

As shown in FIG. 7, according to the current invention, the distal end 61 of the nose punch 52 has (i) a radius of curvature $R_3'$ adjacent its inner wall 62, (ii) a radius of curvature $R_4'$ adjacent its outer wall 63, and (iii) a diameter $D_2'$. According to the current invention, (i) the radii of curvature $R_3'$ and $R_4'$ of the nose punch 52 are equal to the radii of curvature $R_3$ and $R_4$ of the inner surface 29 of the nose 16 of the can bottom 16 discussed above, and (ii) the diameter $D_2'$ of the nose punch is equal to the diameter $D_2$ of the nose of the can bottom discussed above. Thus, preferably, the radius of curvature $R_3'$ of the distal end 61 of the nose punch 52 adjacent its inner wall 62 is greater than 0.060 inch. Most preferably, (i) the distal end 61 of the nose punch 52 is formed by a sector of a circle so that the radius of curvature $R_4'$ adjacent the outer wall 64 is equal to $R_3'$, (ii) the radius of curvature $R_3'$ is also less than 0.070 inch, and (iii) the diameter $D_2'$ is no greater than 1.89 inch when making a can having a size 202 end or smaller.

The present invention may be embodied in other specific forms without departing from the spirit or essential attributes thereof and, accordingly, reference should be made to the appended claims, rather than to the foregoing specification, as indicating the scope of the invention.

What is claimed:

1. An apparatus for forming the bottom of a can, said can bottom having an annular nose formed therein, comprising:

a) a centrally disposed die having a forming surface that is approximately dome-shaped and upwardly convex, said forming surface having a radius of curvature no greater than about 1.475 inches;

b) a nose punch movable relative to said die, said nose punch having a distal end, said distal end formed by inner and outer circumferentially extending walls joined by a downwardly convex arcuate portion, said arcuate portion having a radius of curvature adjacent said inner wall that is within the range of 0.060 to 0.070 inches; and c) a ram for causing relative motion between said nose punch and said die.

2. The apparatus according to claim 1, wherein said forming surface has a radius of curvature no greater than about 1.45 inches.

* * * * *

UNITED STATES PATENT AND TRADEMARK OFFICE

CERTIFICATE OF CORRECTION

PATENT NO. : 6,220,073 B1
DATED : April 24, 2001
INVENTOR(S) : Cheng et al.

It is certified that error appears in the above-identified patent and that said Letters Patent is hereby corrected as shown below:

Column 1,
Line 38, after the word "psi" please insert -- , --.

Column 3,
Line 13, please delete "fit" and insert therefor -- first --.

Column 4,
Line 32, please delete "R.," and insert therefor -- $R_1$, --.
Line 49, please delete "R2" and insert therefor -- $R_2$ --.

Column 6,
Line 51, please delete "Me" and insert therefor -- the --.

Column 10,
Line 34, please delete "VII" and insert therefor -- VIII --.
Line 47, please delete "can" and insert therefor -- cans --.

Signed and Sealed this

Twenty-ninth Day of January, 2002

*Attest:*

*Attesting Officer*

JAMES E. ROGAN
*Director of the United States Patent and Trademark Office*